US008213643B2

(12) United States Patent
Hemer

(10) Patent No.: US 8,213,643 B2
(45) Date of Patent: Jul. 3, 2012

(54) SOUND TRANSDUCER FOR THE TRANSMISSION OF AUDIO SIGNALS

(75) Inventor: Berthold Hemer, Schaafheim (DE)

(73) Assignee: Ceotronics Aktiengesellschaft Audio, Video, Data Communication, Rodermark (DE)

( * ) Notice: Subject to any disclaimer, the term of this patent is extended or adjusted under 35 U.S.C. 154(b) by 1007 days.

(21) Appl. No.: 12/182,188

(22) Filed: Jul. 30, 2008

(65) Prior Publication Data

US 2009/0041269 A1 Feb. 12, 2009

(30) Foreign Application Priority Data

Aug. 9, 2007 (DE) ..... 10 2007 037 561

(51) Int. Cl.
*H04R 1/08* (2006.01)
*H04R 17/02* (2006.01)

(52) U.S. Cl. ..... 381/151; 381/326; 381/380; 381/353; 381/354

(58) Field of Classification Search ..... 381/151, 381/326, 380, 346–348, 353, 354
See application file for complete search history.

(56) References Cited

U.S. PATENT DOCUMENTS

| | | | | |
|---|---|---|---|---|
| 4,258,229 | A * | 3/1981 | Eggert et al. | 600/546 |
| 4,763,307 | A * | 8/1988 | Massa | 367/174 |
| 4,868,799 | A * | 9/1989 | Massa | 367/172 |
| 4,924,502 | A * | 5/1990 | Allen et al. | 381/72 |
| 4,985,925 | A * | 1/1991 | Langberg et al. | 381/71.6 |
| 5,186,162 | A * | 2/1993 | Talish et al. | 601/2 |
| 5,859,916 | A * | 1/1999 | Ball et al. | 381/326 |
| 5,909,498 | A * | 6/1999 | Smith | 381/380 |
| 6,389,140 | B1 * | 5/2002 | Wei | 381/173 |
| 6,463,157 | B1 * | 10/2002 | May | 381/151 |
| 6,519,345 | B1 * | 2/2003 | Yang | 381/151 |
| 6,754,359 | B1 * | 6/2004 | Svean et al. | 381/328 |
| 6,897,601 | B2 * | 5/2005 | Birth et al. | 310/334 |
| 7,241,258 | B2 * | 7/2007 | Miller et al. | 600/25 |
| 7,778,430 | B2 * | 8/2010 | Nakajima et al. | 381/151 |
| 2004/0146172 | A1 * | 7/2004 | Goswami et al. | 381/378 |
| 2004/0247143 | A1 * | 12/2004 | Lantrua et al. | 381/151 |
| 2006/0140434 | A1 * | 6/2006 | Yang | 381/380 |
| 2008/0181437 | A1 * | 7/2008 | Suzuki et al. | 381/191 |

FOREIGN PATENT DOCUMENTS

| | | |
|---|---|---|
| DE | 3023155 | 8/1980 |
| DE | 8903602 | 3/1989 |
| DE | 200 12 846 | 7/2000 |
| DE | 10137424 | 4/2003 |
| EP | 0618751 | 3/1994 |
| EP | 618751 A1 * | 10/1994 |
| JP | 3108997 | 5/1991 |
| JP | 5022784 (A) | 1/1993 |

* cited by examiner

*Primary Examiner* — Long Tran
*Assistant Examiner* — Jordan Klein
(74) *Attorney, Agent, or Firm* — Law Offices of Peter H. Priest, PLLC

(57) ABSTRACT

A sound transducer for the transmission of audio frequency signals with a pressure-voltage transducer is provided. This pressure-voltage transducer is disposed on a supporting plate and at least partially embedded in a sound-insulating, substantially incompressible material, for example a gel. The supporting plate rests herein in contact on a body part, for example a jaw or skull bone, of a person. If this person conducts a conversation, the vibrations of the bone generated through the conversation are transmitted to a supporting plate. This supporting plate subsequently transmits the vibrations onto the pressure-voltage transducer, for example a piezoelectric element or an electret element.

19 Claims, 3 Drawing Sheets

SOUND TRANSDUCER FOR THE TRANSMISSION OF AUDIO SIGNALS

Figure 1:
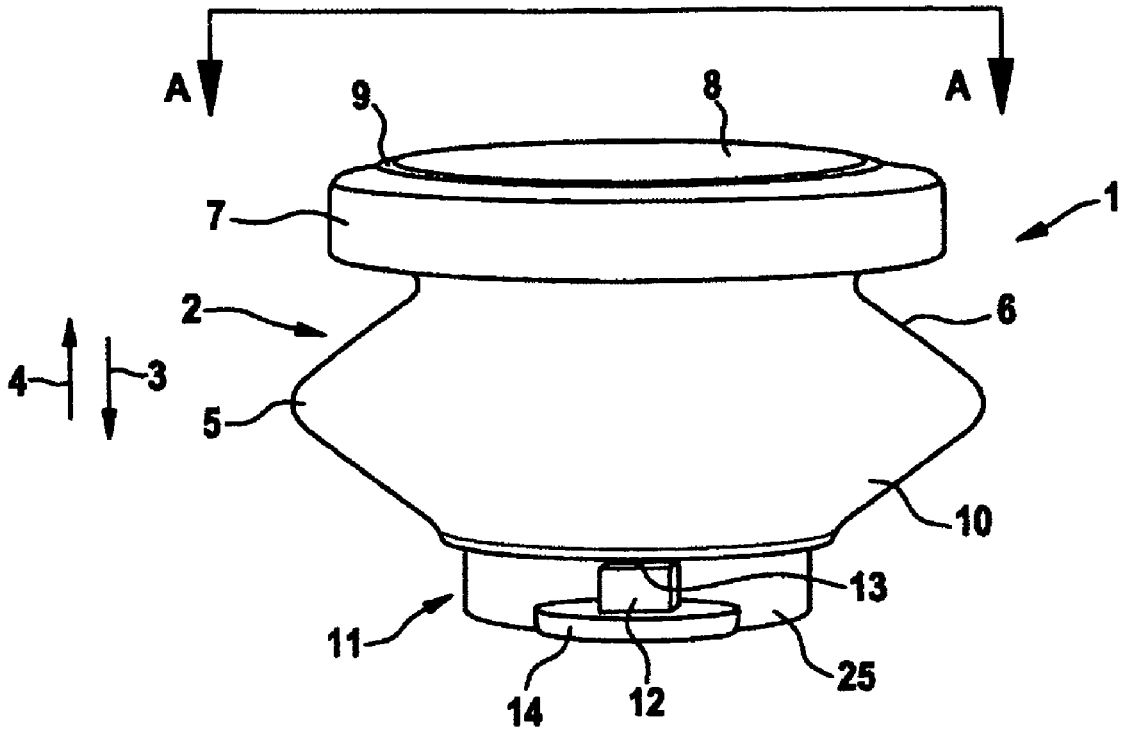

The invention relates to a sound transducer for the transmission of audio frequency signals according to the preamble of patent claim 1.

Radiotelephones are currently employed in the military as well also in the civilian field. With these devices it is possible for persons to communicate across long distances. Depending on the use, an accessory, a so-called talk-listen system or walkie-talkie, is often connected. This permits the use of the radiotelephones in the presence of loud noises.

In the case of walkie-talkies the microphone is most often in front of the mouth of the particular person. Such a microphone is frequently voice-controlled, i.e. the acoustic signals further transmitted from this microphone are also only further transmitted if these signals are voice signals. It is thereby prevented that the transmission action is also initiated by noise in the environment.

However, these walkie-talkies are not suitable if the bearer must wear a helmet with visor or a respiratory mask. For that reason, solid-borne sound microphones have been developed which can be worn on the inside of a helmet and are in connection with the skull.

A solid-borne sound microphone is known, for example, which can be brought into contact with the body whose acoustic vibrations are to be sensed, wherein a pick-up, which is, at least with partial regions, displaceable, is provided and which carries the microphone (EP 0 618 751 A1). The pickup is in this case a fold bellows.

Known is also a housing with an inner container comprised of resin, which has attenuation properties (JP 03108997). This inner container is disposed in a gel-like material and is connected with the housing via a connection element. With the gel-like material is connected a vibration pick-up mechanism, this vibration pick-up mechanism being disposed on a body part, for example on a cheek bone, whereby vibrations of this bone can be sensed.

Further known is a contact microphone for sensing the human voice through body vibrations (DE 30 23 155 A1). This contact microphone comprises a housing with a piezoelectric element and with a contact element disposed between the piezoelectric element and the human body. This contact microphone consequently forms a force transducer. The area of the contact element coming into contact with the human body is significantly larger than the cross sectional area of the piezoelectric element transversely to its longitudinal axis.

Further known is an arrangement for listening to voice or music signals, in which the transmission of the signals takes place via the skull bone (US 2004/0247143 A1). This arrangement includes a container which is divided into a front and rear chamber. Between these two chambers is disposed a piezoelectric element. The front chamber is herein filled with an incompressible gel or an incompressible fluid and the rear chamber is filled with attenuation means. These means disposed in the two chambers serve for compensating forces to which the piezoelectric element is exposed.

The present invention addresses the problem of providing a sound transducer for the transmission of audio frequency signals in which the vibration sensitivity is still further increased.

This problem is solved according to the features of patent claim 1.

The invention therewith relates to a sound transducer for the transmission of audio signals with a pressure to voltage transducer. This pressure-voltage transducer is disposed on a supporting plate and is at least partially embedded in a sound insulating, substantially incompressible material, for example a gel. The supporting plate is resting in contact on a body part, for example the cheek or skull bone, of a person.

Of advantage is herein that between the bone and the pressure-voltage transducer the supporting plate is disposed such that the vibration sensitivity is considerable increased.

When a person conducts a conversation, the vibrations of the bone generated by the conversation are transmitted to the supporting plate. This supporting plate subsequently transmits the vibrations onto the pressure-voltage transducer, for example a piezoelectric element or an electret element.

Of advantage is further that the substantially incompressible material projects at least partially from a bellows, for example a fold bellows, this bellows, in turn, being attached in a head cover, for example a helmet.

By actuating the bellows the distance of the support plate from the bone can be so changed that the supporting plate always rests firmly on the particular bone.

An embodiment example of the invention is depicted in the drawings and will be explained in further detail in the following. In the drawing depict:

FIG. 1 a perspective side view of a sound transducer for the transmission of audio signals, FIG. 2 a perspective view from below of the sound transducer depicted in FIG. 1, FIG. 3 a perspective view of the sound transducer depicted in FIG. 1 from above, FIG. 4 a section along A-A through the sound transducer depicted in FIG. 1, FIG. 5 a further view of the sound transducer according to FIG. 1 in the opened state.

In FIG. 1 is shown a sound transducer 1 for the transmission of audio signals. Evident is a bellows 2, which can preferably be stretched or compressed in the direction of arrows 3 or 4, respectively. This bellows 2 comprises two oppositely directed truncated cones 6, 10. The bellows 2 is preferably comprised of a substantially flexible material. The bellows 2 can thus, for example, be comprised of rubber such that in the case depicted in FIG. 1, the bellows is a fold bellows 2.

On the upper truncated cone 6 of the fold bellows 2 is evident an annular disk 7 which is a component part of the fold bellows 2 and which is comprised of the same material as the bellows. By 9 is denoted the edge of a cover. This cover 8 is comprised of polymers, for example of acrylonitrile butadiene styrene terpolymer (ABS) or of polyamides. Bellows 2 and annular disk 7 are preferably comprised of rubber.

On the lower truncated cone 10 of fold bellows 2 is evident a cylindrical capsule 11. The interior of this capsule 11 can be filled, for example, with a gel. The gel is herein encompassed by a microfilm (μ-film) 25. Preferably in the center of the lower region of capsule 11 is disposed a pressure-voltage transducer 12.

If the interior or the capsule contains gel, pressure-voltage transducer 12 and capsule 11 form a so-called gel microphone. The pressure voltage-transducer 12 is connected with an electric line 13 to a [impedance] matching or microphone amplifier, which is located in the lower region of the cover 8. However, the matching amplifier is not shown in FIG. 1.

The line 13 can be soldered onto the pressure-voltage transducer 12 or be connected by means of a plug disposed on the line 13, which plug is not shown here, to the pressure-voltage transducer 12.

The pressure-voltage transducer 12 includes a piezoelectric element or also an electret element. It is also conceivable that the pressure-voltage transducer comprises an electrodynamic transducer comprised of coil and magnet. However, electret elements are preferably utilized.

The thin flexible μ-film 25 encompassing the gel of the capsule 11 serves for the purpose of sealing such that gel located in the capsule 11 cannot leak out of the fold bellows 2. This film 25 is depicted as being transparent in FIG. 1 in order for the pressure-voltage transducer 12 to be visible. However, a film can also be applied that is not transparent. Furthermore can be seen a circular supporting plate 14 which is connected to the pressure-voltage transducer 12. This supporting plate 14 engages into the capsule 11 such that it is firmly disposed here. The supporting plate 14 serves for increasing the vibration sensitivity and further as a strain relief of the line embedded in capsule 11. The supporting plate 14 can be comprised, for example, of acrylonitrile butadiene styrene or of a polyamide.

It is understood that, instead of with a gel, the capsule 11 can also be filled with another material, provided the material has a Shore hardness similar to that of gel. Although there is a μ-film 25 yet disposed about capsule 11, the material has preferably such Shore hardness that it cannot leak from the fold bellows by itself. The viscosity of the gel corresponds approximately to the viscosity of the gel utilized in breast enlargement operations.

Figure 2:
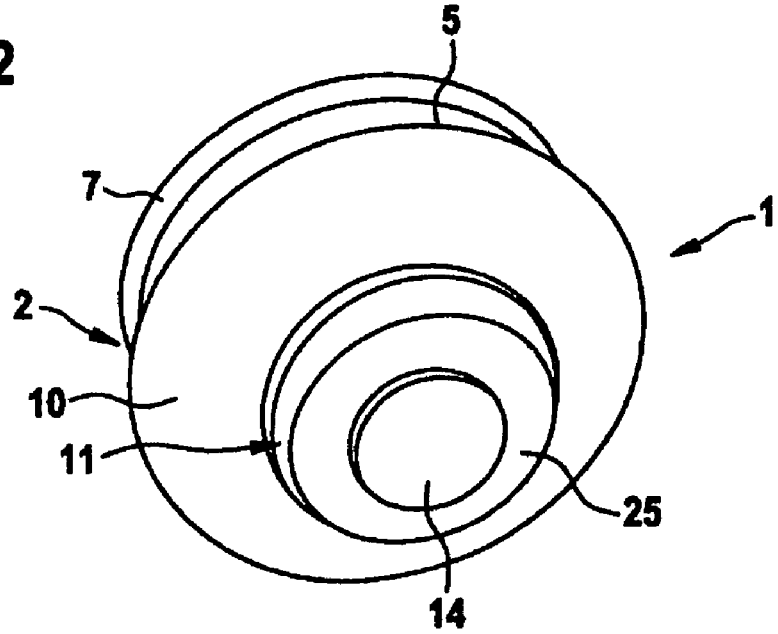

FIG. 2 shows a perspective view of the sound transducer 1 depicted in FIG. 1 for the transmission of audio signals. The sound transducer 1 is here slightly inclined to one side. It can be seen that the capsule 11 is disposed on the lower region of the truncated cone 10.

The supporting plate 14 is disposed centrally in the lower portion of capsule 1. On this supporting plate 14 is disposed the pressure-voltage transducer 12, which, however, is not evident in FIG. 2. During operation the supporting plate 14 rests in contact on the head of the user.

As can be seen in FIG. 2, the capsule 11 disposed on the bellows 2 has a round shape. The diameter is at least 10 mm. However, the capsule can also have different dimensions and shapes.

Figure 3:
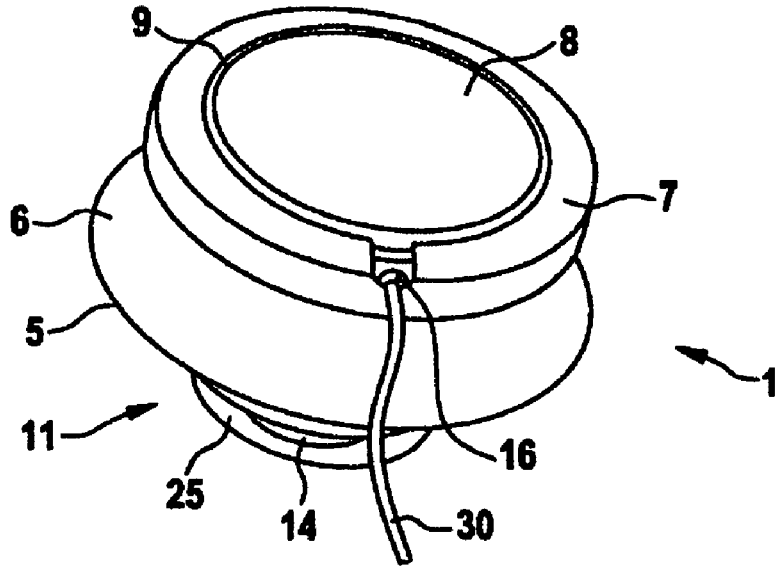

FIG. 3 depicts the sound transducer 1 for the transmission of audio signals according to FIG. 1 in a perspective view from above. The sound transducer 1 is here also slightly inclined to one side. The cover 8 is inserted in the annular disk 7 of bellows 2. This cover 8 includes a guard 16 against turning out of place. For this purpose on the top side of the annular disk 7 a groove is provided, into which engages the turn guard 16 which is formed, for example, as a tab. Beneath this turn guard 16 is located a cable 30 which is not visible in FIGS. 1 and 2.

Figure 4:
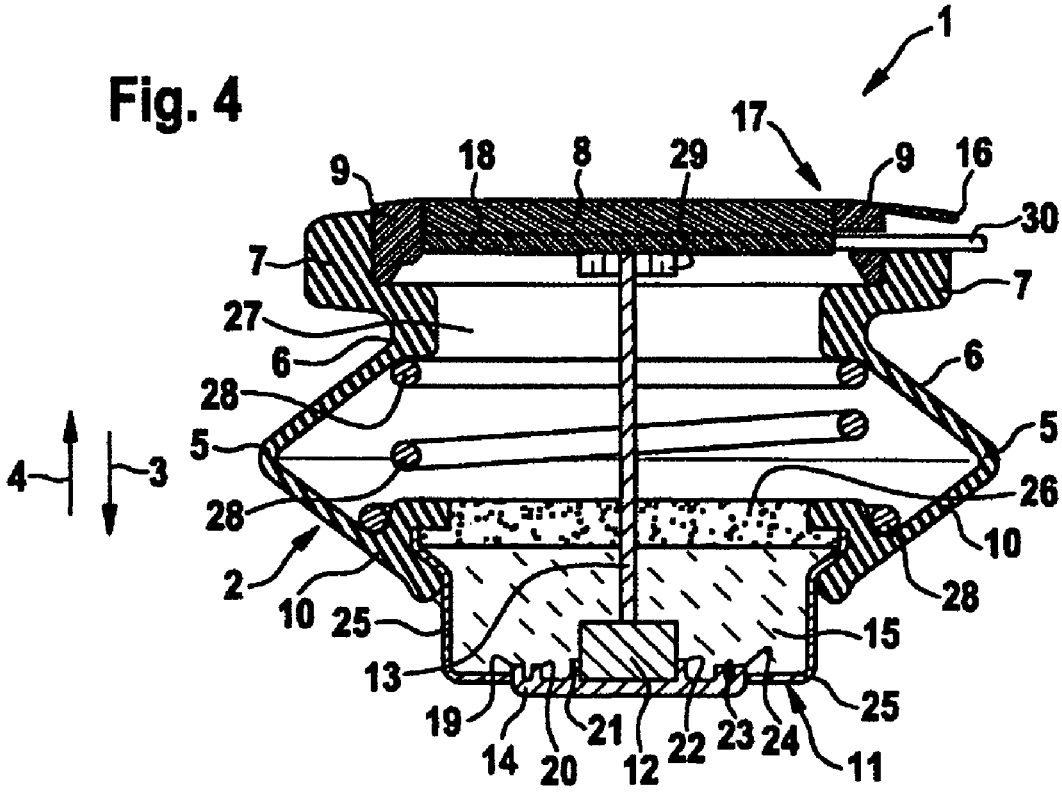

FIG. 4 shows a section along A-A through the sound transducer 1 for the transmission of audio signals depicted in FIG. 1.

As already stated, into the annular disk 7 the cover 8 is fitted. This cover 8 is preferably comprised of a synthetic material or a different polymer. The cover 8 contains the electronic circuitry on a printed circuit board 18. By pulling the elastic annular disk 7 off to the side, the cover 8 with printed circuit board 18 can be removed. The cover 8 can also be inserted again into the bellows 2 in corresponding manner.

Further can be seen the turn guard 16. This turn guard 16 prevents the line 13 from being torn off with an unintentional turning of the cover 8. The annular disk 7 has an indentation into which fits the turn guard 16. Beneath the turn guard 16 can be seen the cable 30. This cable 30 is a connection line provided with a plug, the plug not being visible. Cable 30 is in contact with printed circuit board 18.

Not evident in FIG. 4 is a turn-lock closure disposed opposite the turn guard 16 and located in a groove of the cover. The groove-and-tongue arrangement is thus formed on the opposite side precisely in reverse to the turn guard shown in FIG. 3.

The matching amplifier located on printed circuit board 18 includes a circuit which processes the vibrations coming from the pressure-voltage transducer 12 in terms of electromagnetic compatibility; it converts the processed vibrations and provides them as final microphone signal. This microphone signal can be further transmitted via microphone inputs suitable for this purpose of devices, for example radio devices, intercom systems, communicator systems, etc.

If the cover 8 with the printed circuit board 18 disposed thereon is removed, it is only necessary to disconnect the electric line 13 from the printed circuit board 18. For this purpose the electric line 13 can, for example, be of a length which is greater than the distance between the printed circuit board 18 and the pressure-voltage transducer 12. Thereby the cover 8 with the printed circuit board 18 can be removed without line 13 being torn. By press-releasing a terminal 29, via which the line 13 is in contact with printed circuit board 18, the line 13 is detached from the printed circuit board 18. Therewith the cover 8 with the printed circuit board 18 can be removed from the bellows 2 without encountering any problems. Line 13 thus has the function of a connection cable.

Before the cover 8 is placed on again, line 13 is first fastened on the printed circuit board 18 again via the terminal 29. The printed circuit board 18 can thus be replaced in simple manner.

Instead of terminal 29, a socket can here also be disposed. Into this socket, line 13 can be plugged. This takes preferably place thereby that line 13 includes at this end a plug which can be plugged into the socket. It is understood that it is also conceivable that line 13 is simply soldered onto the printed circuit board 18.

Via the electrical line 13 the printed circuit board 18 is connected to the pressure-voltage transducer 12. This pressure-voltage transducer 12 is preferably an electret element. The pressure-voltage transducer 12 is here at least partially disposed in a material 15, preferably a gel 15. Gel 15 and pressure-voltage transducer 12 form the so-called gel microphone.

Seen can be furthermore that the pressure-voltage transducer 12 is disposed on the circular supporting plate 14. This supporting plate 14 engages with projections 19 to 24 into the gel 15 such that the supporting plate 14 is firmly anchored in the gel 15 and thus with the capsule 11. The projections 21, 22, in addition, encompass the lower region of the pressure-voltage transducer 12. They thus serve as clamping means wherewith the supporting plate 14 is firmly disposed on the pressure-voltage transducer 12.

The supporting plate 14 serves for increasing the contact area and therewith for increasing the vibration sensitivity. It serves simultaneously as a strain relief for the line 13 embedded in the capsule 11. As can also be seen in FIG. 4, line 13 can be disposed at the upper region of the pressure-voltage transducer 12. However, it is also feasible that line 13 extends laterally and is guided in a groove which is formed by the projections 19, 20. Strain relief of line 13 is attained in both cases.

It can further be seen that the gel 15 is at least partially disposed in the truncated cone 10. The other portion is outside of the truncated cone 10 and, together with a portion of the μ-film 25, forms capsule 11. This capsule 11 can project, for example, up to 10 mm from the lower truncated cone 10. The μ-film 15, in addition, prevents direct skin contact with the gel 15.

The μ-film 25 is disposed around the gel 15 in order to prevent leakage of the gel 15 from the lower region of the truncated cone 10. Above gel 15 is disposed a further material 26. This material 26 has a lower viscosity or greater hardness than gel 15, whereby gel 15 cannot reach the interior region 27 of the fold bellows 2. Measuring the hardness of the gel can be carried out, for example, according to Shore with a spring-elastic pin whose penetration depth is a measure of the corresponding hardness. This material 26 can be, for example, a resin or a different gel. It can also be the same gel which has only become harder through another treatment.

In FIG. 4 can further be seen a portion of a spring 28 which is comprised of a substantially flexible material, for example, a metal or a metal alloy. The spring 28 can be comprised, for example, of spring steel. However, instead of a spring, for example, a foamed material can be utilized which at least partially fills out the interior region 27. This spring 28 or the foamed material serves for the purpose of absorbing a force which acts, for example, from above onto the cover 8. When the spring 28 absorbs this force, it becomes deformed whereby the fold bellows 2 is stretched or compressed in direction 3 or 4, respectively. During operation there must be a vertical minimum force in order for the sound transducer to rest flush on the head.

In principle, a flat spiral spring is not required since the fold bellows also develops reset forces. However, in practice it has been found that, for example, rubber of which the fold bellows 2 is comprised, ages over time and its reset forces become weaker. For that reason, the flat spiral spring, which virtually does not age, is of advantage.

Of advantage in this embodiment of the sound transducer 1 is further that the pressure-voltage transducer 12, at least partially embedded in the gel 15, as well as the supporting plate 14 disposed thereon can be removed from the fold bellows 2 by pulling out the gel encompassed by the μ-film 25. A replacement of a defective gel microphone is therewith simply and quickly possible. For that purpose line 13 only needs to be removed from the printed circuit board 18.

The matching or microphone amplifier can either be disposed in the interior region 27 of the fold bellows 2 or also outside of the interior region 27. However, it is preferred that it be located between the pressure-voltage transducer 12 and the cover 8.

In the center of the cover 8 is located an opening, not shown in FIG. 4, which can have a diameter of, for example, 6 mm. Through this opening a screw driver can be inserted with which a screw disposed on the printed circuit board 18 can be adjusted. This screw as well as the screw driver, however, are not shown in FIG. 4. By adjusting the screw, the microphone level can be set or changed. Calibration of the sound transducer 1 is therewith possible.

In the following the operational function of the sound transducer 1 will be explained and specifically for the case that this sound transducer 1 is disposed in a helmet and the helmet is being worn by a person on the head. The helmet and the head of the person are, however, not shown in FIG. 4. First, the sound transducer 1 must be set by exerting a force onto the fold bellows 2, preferably onto the supporting plate 14, such that the supporting plate 14 rests with slight pressure on the head. This adjustment preferably takes place through an appropriate disposition in the helmet. The supporting plate 14 subsequently preferably rests directly in contact on the skull bone or jaw bone of this person.

If this person now carries on a conversation, the skull or jaw bone vibrates at a very specific frequency spectrum such that these vibrations are transmitted to the supporting plate 14. This supporting plate 14 transfers these vibrations further to the pressure-voltage transducer 12, preferably an electret element. Of advantage in the supporting plate 14 is that it increases the vibration sensitivity since it rests in contact on the body part with a larger surface than the pressure-voltage transducer 12.

After the vibrations have been sensed by the pressure-voltage transducer 12, an electric current is conducted via the electric line 13 to the matching or microphone amplifier. This amplifier can subsequently amplify the signal and optionally filter out interference noise.

Apart from the matching or microphone amplifier, which can also serve as a filter of undesirable interference signals, the material 15, however, functions as a mechanical filter since it encompasses the pressure-voltage transducer 12 on three different sides. To a large degree the vibrations coming from the surrounding are not allowed to pass through to the pressure-voltage transducer 12 by the material 15, for example by the gel or by the acoustic foam, since the material 15 absorbs them. Thereby the main portion of the vibrations from the body part reaches the pressure-voltage transducer 12, since here the supporting plate 14 rests in contact and transmits the vibration directly to the pressure-voltage transducer 12.

Interference noise can be nearly excluded through suitable selection of the material 15.

It is further conceivable to implement the sound transducer 1 without a capsule 11 also. In this case the pressure-voltage transducer 12 is disposed in the bellows 2. Herein only the supporting plate 14 is located outside of the truncated cone 10, with the supporting plate 14 and the pressure-voltage transducer 12 being connected with one another.

Through the fold bellows 2 the sound transducer 1 can not only be built into helmets but rather into any type of head cover. For this purpose, one fold of the fold bellows 2, similarly to a button into a button hole, is inserted into an opening disposed on the head cover. It is, for example, possible to introduce the upper fold, i.e. the truncated cone 6, into an opening. In the case of the helmet, this opening could be punched into the foamed material layer which is disposed in the interior of the helmet. Into this opening is subsequently inserted the truncated cone 6. Since therewith only one opening needs to be provided in a head cover, the sound transducer can be inserted into any head cover.

Figure 5:
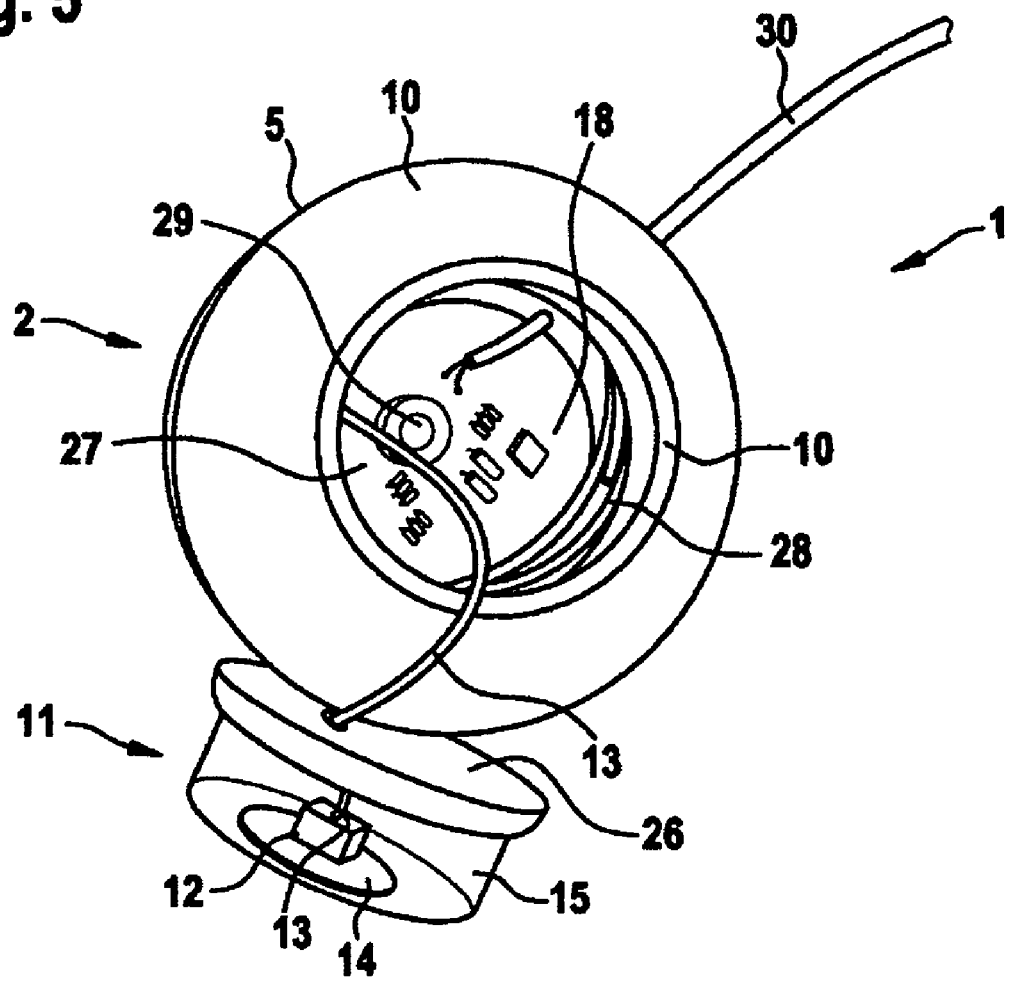

FIG. 5 shows a further view of the sound transducer 1 according to FIG. 1, after the capsule 11 has been removed so that it is possible to view the interior region 27 of the sound transducer 1.

Again, the pressure-voltage transducer 12 can be seen, which rests on the supporting plate 14. Projections 19 to 24 are not shown for the sake of simplicity. The pressure-voltage transducer 12 is connected across line 13 to the printed circuit board 18. On the printed circuit board 18 is disposed a terminal 29, via which line 13 is attached to the printed circuit board 18. By loosening the terminal 29, the line 13 can be detached from the printed circuit board 18. The individual components of the printed circuit board 18 are not further shown for the sake of simplicity.

On the capsule 11 the further material 26 is disposed, which had been removed with the capsule 11 from the sound transducer 1. Like the gel 15, the material 26 can also be encompassed by a μ-film. Such a μ-film, however, is not shown in FIG. 5.

In the interior region 27, in addition, a spring 28 is evident.

The invention claimed is:

1. Sound transducer (1) for the transmission of audio frequency signals, which can be brought into contact with at least one body part, with a pressure-voltage transducer (12)

being in connection with a supporting plate (14) for resting in contact on the body part, which plate has a larger surface area than the pressure-voltage transducer (12), whereby a sound-insulating material (15) encompasses at least partially the pressure-voltage transducer (12), wherein the sound-insulating material (15) is at least partially disposed in a stretchable and compressible bellows (2) and that the supporting plate (14) is at least partially disposed outside of said bellows (2).

2. Sound transducer as claimed in claim 1, wherein the sound-insulating material (15) is at least partially encompassed by an elastic microfilm (25).

3. Sound transducer as claimed in claim 1, wherein the sound-insulating material (15) is a gel (15).

4. Sound transducer as claimed in claim 1, wherein the sound-insulating material (15) is an acoustic foam (15).

5. Sound transducer as claimed in claim 1, wherein the bellows (2) is a fold bellows and includes two oppositely directed truncated cones (6, 10).

6. Sound transducer as claimed in claim 1, wherein the pressure-voltage transducer (12) is an electret element.

7. Sound transducer as claimed in claim 1, wherein the pressure-voltage transducer (12) is a piezoelectric element.

8. Sound transducer as claimed in claim 1, wherein the pressure-voltage transducer (12) is an electrodynamic transducer.

9. Sound transducer as claimed in claim 1, wherein the bellows (2) is closed off by a cover (8), which cover includes a printed circuit board (18) with electronic components.

10. Sound transducer as claimed in claim 9, wherein the electronic components include a matching or microphone amplifier which is connected to the pressure-voltage transducer (12) via an electrical line (13).

11. Sound transducer as claimed in claim 10, wherein the matching or microphone amplifier is disposed on a printed circuit board (18) in a removable cover (8).

12. Sound transducer as claimed in claim 11, wherein the printed circuit board (18) is provided on the cover (8) and includes a terminal (29) with which the line (13) is held.

13. Sound transducer as claimed in claim 1, wherein a matching or microphone amplifier is disposed in the sound-insulating material (15).

14. Sound transducer as claimed in claim 1, wherein the supporting plate (14) includes projections (21, 22) which engage into the sound-insulating material and at least partially encompass the pressure-voltage transducer (12).

15. Sound transducer as claimed in claim 1, wherein in the bellows (2) a flat spiral spring (28) is provided.

16. Sound transducer as claimed in claim 15, wherein the bellows (2) on its inside and in the upper region includes a projection, which serves as a brace for one side of the flat spiral spring (28), and that the bellows (2) on its inside and in the lower region includes a recess into which the other side of the flat spiral spring (28) engages.

17. Sound transducer as claimed in claim 1, wherein the sound-insulating material (15) is closed off on one side by a plate (26) comprised of a material of lower viscosity than the viscosity of the sound-insulating material (15).

18. Sound transducer as claimed in claim 1, wherein the sound-insulating material (15), together with a μ-film (25), forms a capsule (11) which projects from the bellows (2).

19. Sound transducer as claimed in claim 1, wherein the bellows (2) comprises at its lower end a microfilm (25) as well as a plate (26) with lower viscosity than the viscosity of the sound-insulating material.

* * * * *